US005082502A

United States Patent [19]

Lee et al.

[11] Patent Number: 5,082,502

[45] Date of Patent: Jan. 21, 1992

[54] CLEANING APPARATUS AND PROCESS

[75] Inventors: Kam B. Lee, Chelmsford; Allan C. Morgan, Manchester, both of Mass.; L. Willard Richards, Santa Rosa, Calif.; Dan K. Puckett, Pampa, Tex.

[73] Assignee: Cabot Corporation, Waltham, Mass.

[21] Appl. No.: 241,454

[22] Filed: Sep. 8, 1988

[51] Int. Cl.[5] ..... B08B 9/02

[52] U.S. Cl. ..... 134/1; 134/17; 134/21; 134/22.12; 134/22.18; 134/37; 137/15; 164/132

[58] Field of Search ..... 134/1, 17, 21, 22.12, 134/22.18, 37; 137/15; 164/132

[56] References Cited

U.S. PATENT DOCUMENTS

| | | | |
|---|---|---|---|
| 2,690,960 | 10/1954 | Kistiakowsky et al. | 23/209.7 |
| 2,714,563 | 8/1955 | Poorman et al. | 117/105 |
| 2,752,272 | 6/1956 | Fay | 134/17 |
| 2,839,435 | 6/1958 | Boswell | 134/17 |
| 3,364,983 | 1/1968 | Krinov et al. | 165/1 |
| 3,910,494 | 10/1975 | Melton, Jr. | 239/13 |
| 4,089,702 | 5/1978 | Enoksson et al. | 134/1 |
| 4,120,699 | 10/1978 | Kennedy, Jr. et al. | 134/1 |
| 4,461,651 | 7/1984 | Hall | 134/1 |
| 4,642,611 | 2/1987 | Koerner | 340/385 |
| 4,645,542 | 2/1987 | Scharton et al. | 134/1 |
| 4,655,846 | 5/1987 | Scharton et al. | 134/1 |
| 4,699,665 | 10/1987 | Scharton et al. | 134/1 |

*Primary Examiner*—Asok Pal
*Attorney, Agent, or Firm*—Lawrence A. Chaletsky

[57] ABSTRACT

Particles adhering to the internal surfaces of an object are removed by the movement of a shock wave past the surfaces. The shock wave is generated by the explosion of a gas in a chamber located inside the object. The invention has particular application for use in cleaning process equipment.

7 Claims, 3 Drawing Sheets

CLEANING APPARATUS AND PROCESS

BACKGROUND OF THE INVENTION

1. Field of the Invention

The present invention relates to a new apparatus and method for removing deposits from the internal surfaces of process equipment. More particularly the present invention relates to a gas explosion apparatus and process used to drive a shock wave through objects to be cleaned. The movement of the shock wave through the object dislodges deposits inside the objects.

2. Background

Fouling of the internal surfaces of process equipment is a common problem. In many instances this fouling occurs through a build-up of deposits or particles adhering to the internal surfaces. This fouling usually reduces the efficiency of the piece of equipment Thus, cleaning the internal surfaces is necessary to maintain peak efficiency in the equipment.

One generally known method for cleaning utilizes pressure pulses to dislodge deposits The pressure pulse cleans by first subjecting the deposit laden surface to a very high pressure and then to a much lower pressure. The pressure differential causes the deposits to expand and to become dislodged from the surface. To clean the internal surface of a piece of equipment the pressure pulse must move through equipment creating a moving pressure differential.

Typically pressure pulses are produced by releasing short bursts of high pressure gas through a valve. Gas explosion has also been utilized as a method for producing a shock wave. U.S. Pat. No. 4,089,702 to Enoksson et. al., hereinafter Enoksson, discloses detonating an explosive gas mixture to produce a shock wave which can be used to dislodge particles such as sand and scale from internal surfaces of objects The method of Enoksson, however, has several disadvantages. Enoksson teaches sealing off the outlet means of the equipment to be cleaned and filling the internal cavity of the equipment with an explosive gas. This method disadvantageously requires the halting of any process being performed by the equipment being cleaned. The method also disadvantageously requires cleaning large pieces of equipment in segments, thereby requiring valves or other means in the equipment to seal off the different segments and permit filling the segment with explosive gas. Another disadvantage of Enoksson is that the explosion is not precisely controllable.

U.S. Pat. No. 4 642,611 to Koerner, hereinafter Koerner, discloses a sound engine, for generating sonic waves by igniting a gas. This sound engine, however, is disadvantageous for use in cleaning process equipment. Koerner teaches acoustically cleaning equipment by creating a loud resonant frequency which vibrates or shakes the piece of equipment being cleaned. The vibration or shaking of the equipment causes particles to dislodge from the internal surfaces of the equipment. Koerner also teaches this resonate frequency is a substantially continuous sound. The vibration cleaning of Koerner is disadvantageous or unsuitable, however, for cleaning large pieces of process equipment. Most large pieces of process equipment are rigidly mounted in a manner which makes vibrating the equipment difficult. Also, a large piece of equipment would require the generation of an extremely loud sound to induce vibration for cleaning by Koerner's method. This continuous loud sound would be unpleasant and/or dangerous for people living or working near the equipment being cleaned Koerner also suggests that any process being performed by the piece of equipment to be cleaned must be halted or finished before cleaning begins, Accordingly, one object of the present invention is to overcome the disadvantages of known pulse cleaning equipment by providing an apparatus and method for cleaning which can be used in a piece of process equipment during the process being performed by the equipment without the equipment having to be frequently dismantled.

Another object of the present invention is to provide an apparatus for exploding a gas to produce a shock wave which will move through a piece of process equipment and dislodge deposits and particles adhering to the inner surface of the equipment.

A further object of the present invention is to provide an apparatus which allows for a controlled gas explosion to generate a shock wave.

A still further object of the present invention is to provide an apparatus for exploding a gas to produce a shock wave which can be directed in a certain direction.

A still further object of the present invention is to provide an apparatus for exploding a gas in which the means for igniting the gas do not require frequent replacement.

Other objects and advantages of the present invention will become apparent in the following description of the invention.

SUMMARY OF THE INVENTION

According to the present invention a chamber closed at one end, containing means for creating turbulence, such as a coil spring, is placed inside a piece of process equipment to be cleaned. The chamber is provided with means for admitting a steady stream of air or oxygen enriched air, means for admitting an explosive gas to produce an explosive gas-air mixture in the chamber, and means for igniting the gas-air mixture A timing means, located outside the process equipment, is provided for controlling the means for admitting the explosive gas to the chamber and the ignition means. After a suitable gas-air mixture is produced in the chamber the mixture is ignited by ignition means to produce an explosion shock wave. The means for creating turbulence in the chamber create turbulence which causes this wave to reach supersonic velocities. The movement of the wave at supersonic velocities causes gas in front of the shock wave to move at supersonic velocities and creates an area of great pressure in front of the shock wave.

The explosion wave leaves through the open end of the chamber at supersonic velocity and travels through the process equipment. The internal surfaces of the process equipment are first subject to an area of great pressure as the explosion wave nears and then a rapid reduction of pressure as the explosion wave moves past. This pressure reduction causes deposits and particles adhering the internal surfaces of the equipment to become dislodged. The loose deposits or particles are then removed from the equipment by either the process stream of the process being performed by the equipment or the continuous air stream flowing through the chamber and then through the equipment.

A major advantage of the present invention is that the present invention may be utilized to continually clean a piece of process equipment during the process equipment's operation. If the present invention is utilized in this way the cleaning action of the waves takes place concurrently with the process being performed by the piece of process equipment.

The present invention may also be utilized in many other ways consistent with the following description and claims.

DETAILED DESCRIPTION OF THE INVENTION

Figure 1:
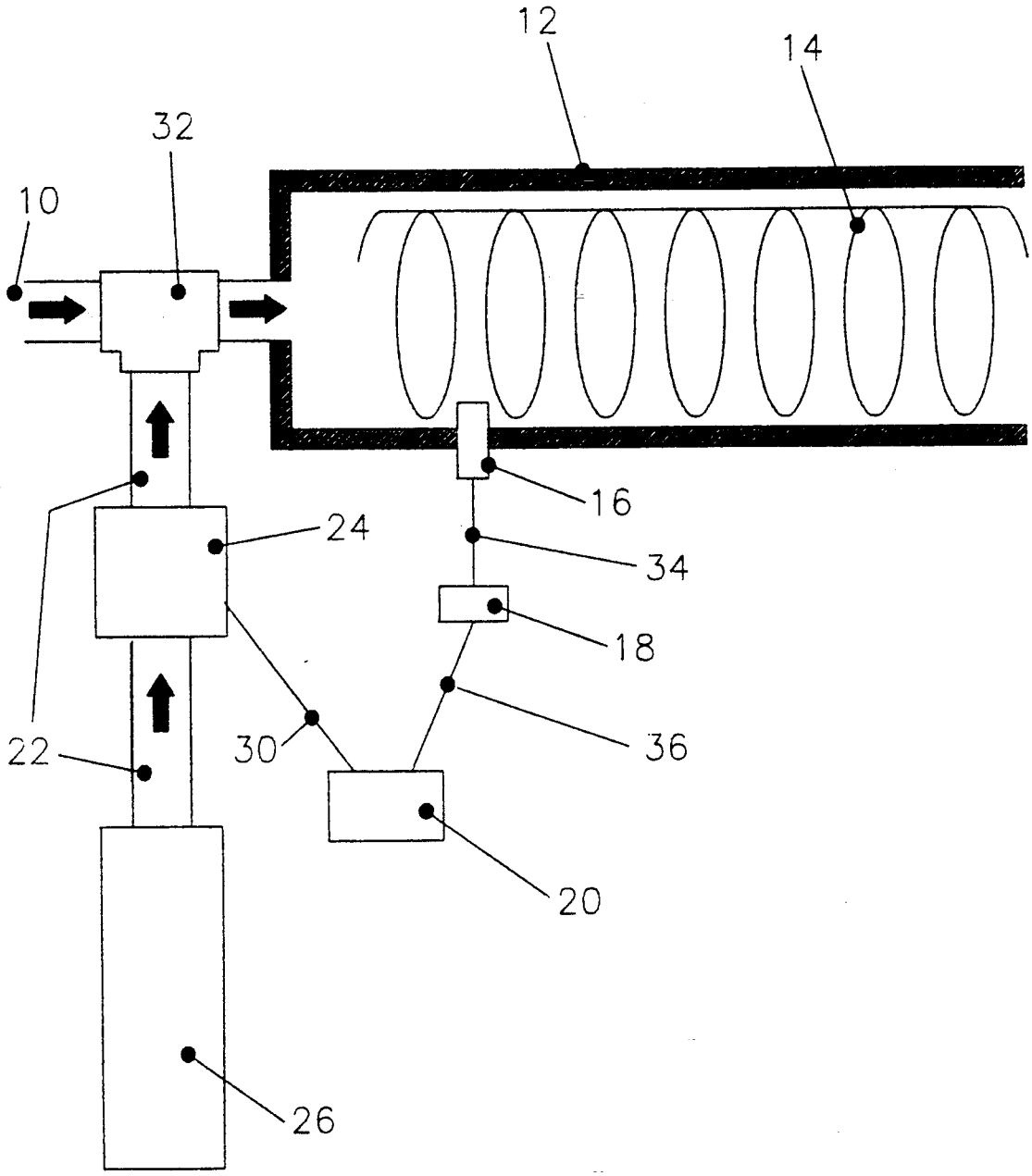
FIG. 1 is a cross-sectional view in side elevation of the gas explosion apparatus of the present invention.

A gas explosion apparatus according to the present invention is shown in FIG. 1. The depicted embodiment of the invention comprises a chamber 12, open at one end, which is usually a cylinder or tube. The chamber 12, contains a coiled spring 14. At the unopened end the chamber 12 is attached to pipe 10. A continuous stream of air or oxygen enriched air flows through pipe 10, into the chamber 12, in the direction indicated by the arrows. Pipe 22 is connected to pipe 10 through the use of a "T" fitting 32. The other end of pipe 22 is connected to a tank 26 containing an explosive gas. A solenoid valve 24 can be open or closed to control movement of the explosive gas from tank 26, through pipe 22, into the "T" fitting 32. When the solenoid valve 24 is open, explosive gas flows from tank 26, through pipe 22, into "T" fitting 32. In the "T" fitting the explosive gas is mixed with the air or oxygen enriched air to form an explosive gas-air mixture. This gas-air mixture is carried by the continuous stream of air in pipe 10 into the chamber 12. Solenoid valve 24 is electrically connected through wires 30 to timer 20. Timer 20 is used to control the amount of time solenoid valve 24 is open and shut, thereby regulating the amount of explosive gas which enters the "T" fitting 32 and therefore the amount of explosive gas in the gas-air mixture which enters the chamber 12. After the solenoid valve 24 remains open for a predetermined length of time, the gas-air mixture in chamber 12 is ignited through ignition means 16 generating a gas explosion shock wave which travels out the open end of the chamber 12. Ignition means 16 may be a spark plug or other suitable means to ignite the gas-air mixture Ignition means 16 is electrically connected through wires 34 to transformer 18. Transformer 18 is electrically connected through wires 36 to timer 20. Timer 20 is used to control the amount of time ignition means 16 is firing or not firing as well as the amount of time the solenoid valve 24 is open and shut.

Figure 2:
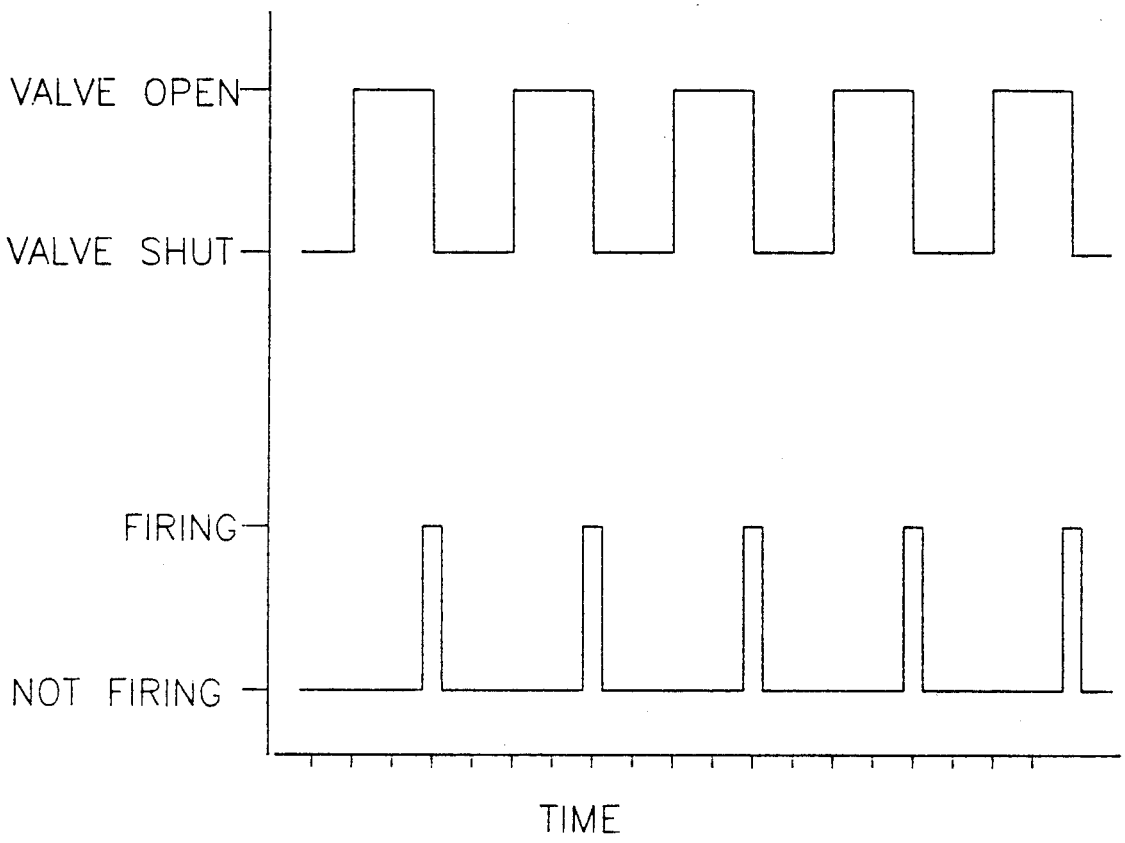
FIG. 2 is a graphic representation of the timing sequence for charging the apparatus with an explosive gas and igniting the gas.

FIG. 2 is a graphic representation of the timing sequence in timer 20 for opening solenoid valve 24 and firing ignition means 16. Generally solenoid valve 24 is open for a time which allows for the formation of an explosive gas-air mixture which will explode to produce a shock wave which will have the desired cleaning effect. Ignition means 16 begins firing near the end of the time period that solenoid valve 24 is open and continues firing into the time period that solenoid valve 24 is shut. Generally ignition means 16 fires for a time period sufficient to ignite the entire gas-air mixture in chamber 12. As shown in FIG. 2, this firing time period is substantially less in time than the valve open time period.

In order to clean a piece of process equipment the chamber 12, with coiled spring 14, ignition means 16 and attached wire 34, and attached pipe 10, is installed inside the piece of equipment to be cleaned. "T" fitting 32, with attached pipe 22, may be located inside or outside of the piece of equipment to be cleaned. Gas tank 26, solenoid valve 24, transformer 18, and timing means 20, are generally located outside the piece of equipment to be cleaned. In this configuration operation of the chamber proceeds as follows. Solenoid valve 24 opens to allow an explosive gas to travel from tank 26 through pipe 22 into "T" fitting 32. The explosive gas is mixed in "T" fitting 32 with air or oxygen enriched air flowing through pipe 10 to form an explosive gas-air mixture This gas-air mixture is carried by the air flowing through pipe 10 into the chamber 12. After the gas-air mixture fills the entire chamber 12, ignition means 16 begins firing. Solenoid valve 24 closes while ignition means 16 is still firing. The firing of ignition means 16 ignites the explosive gas-air mixture generating an explosion wave. This wave travels out the open end of chamber 12 and is supersonic at the point of initial contact with the piece of equipment being cleaned. The wave then continues through the piece of equipment being cleaned. The movement of the wave through the piece of equipment dislodges deposits and particles from the internal walls of the equipment. These deposits and particles are carried away by the process stream flowing through the chamber 12 and the equipment. The continuous air stream also completely removes any combustion products remaining in the chamber 12 before the solenoid valve is reopened.

As discussed above, a major advantage of the present invention is that the entire cleaning process herein described can be performed concurrently with the process ordinarily performed by the piece of process equipment thereby continuously cleaning the equipment during its operation.

Another advantage is that timer 20 allows the timing sequences for opening and closing solenoid valve 24 and for firing ignition means 16 to be varied thereby changing the time interval between explosions. Thus the invention can be tuned as necessary to optimally clean various pieces of process equipment.

In a preferred embodiment of the invention a solid state electronic timer is used to control the opening and closing of the solenoid valve and the firing of the ignition means. This electronic timer has many advantages over a mechanical timer. First, the electronic timer allows for a greater precision in the synchronization of the valve and the ignition means and thereby allows more control over the gas explosion. Second, the electronic timer allows the firing time of the ignition means to be reduced to fractions of a second Reducing the firing time has the great advantage of reducing wear of the ignition means thereby prolonging their useful life. Third, the electronic timer allows a more precise control over the amount of gas admitted to the chamber thereby allowing more control over the force produced by the explosion.

Other advantages of the invention will be illustrated by the following example.

EXAMPLE

The present invention was used to clean a chemical process heat exchanger as follows A chamber was made from an 8 foot long piece of 2 inch diameter pipe, by inserting a 40 inch long coil spring with a 0.75 inch pitch into the pipe. A hole was drilled and tapped near one end of the chamber and a spark plug was inserted into the hole. Wires were attached to the spark plug and the spark plug was electrically connected, via the spark plug wires, to a transformer. The other end of the chamber, away from the spark plug, was inserted substantially co-axially into a fire tube type heat exchanger through a hole in the wall of the heat exchanger. The area surrounding the juncture of the chamber and the heat exchanger was then sealed to prevent escape of gases from the heat exchanger.

The end of the chamber near the spark plug was attached to a second pipe connected through a "T" fitting to a third pipe. The end of the second pipe, past the "T" fitting, was adapted to allow outside air to be forced into the pipe to create a continuous flow of air through the second pipe and "T" fitting into the chamber. The end of the third pipe was attached through a solenoid valve to a tank of methane gas.

Figure 3:
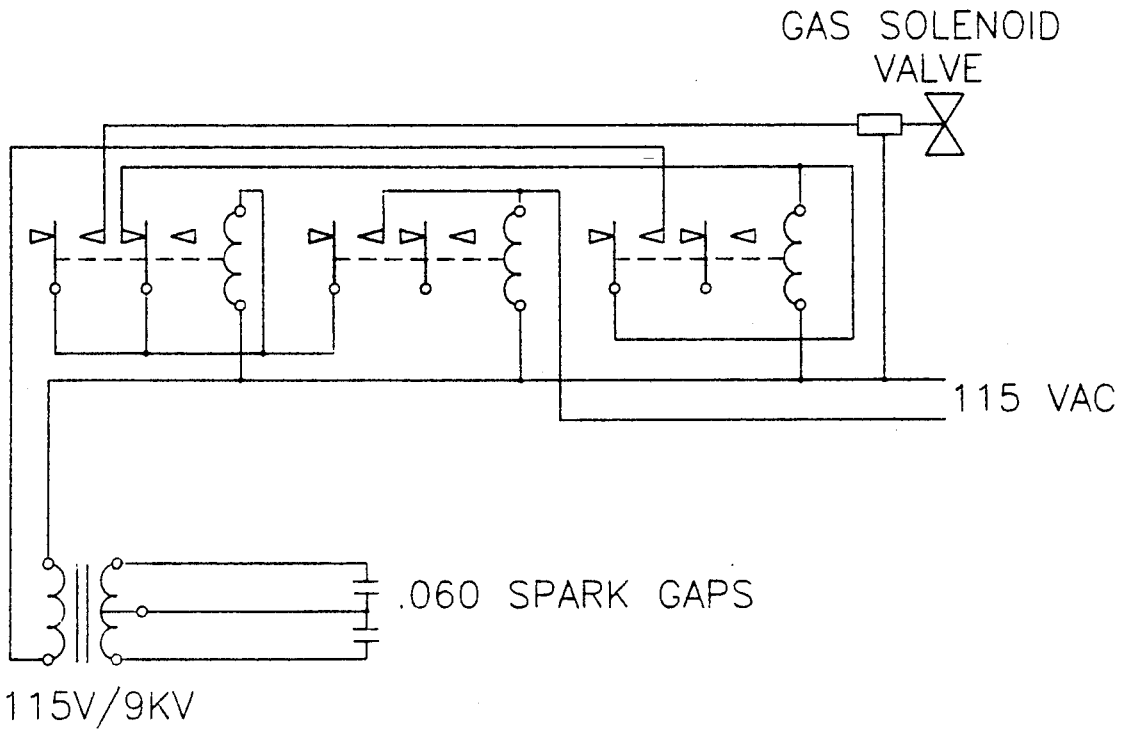
FIG. 3 is a schematic representation of the electrical circuit in a sample embodiment of the invention.

Both the transformer and the solenoid valve were electrically connected via wires to a solid state electronic timer. A schematic of the actual electric circuit is shown in FIG. 3. The timer was set to open the solenoid valve for two seconds every four seconds, and to cause the spark plug to fire for 0.5 seconds every four seconds in the timing sequence illustrated in FIG. 2.

To operate power was supplied to the timer, transformer, and solenoid valve. The opening of the solenoid valve caused methane to flow into the "T" fitting, become mixed with air and enter the chamber as a gas-air mixture. This gas-mixture was then ignited using the spark plug to produce an explosion shock wave which traveled out of the chamber and through the heat exchanger. As the wave moved through the heat exchanger it dislodged particles and deposits from the heat exchanger walls. The dislodged particles and deposits were carried out of the heat exchanger by the process stream flowing through the heat exchanger and the continuous air stream flowing through the chamber and then through the heat exchanger.

Numerous variations and modifications may obviously be made in the structure herein described without departing from the present invention. Accordingly, it should be clearly understood that the forms of the invention herein described and shown in the figures of the accompanying drawings are illustrative only and are not intended to limit the scope of the invention. The present invention includes all modifications falling within the scope of the following claims.

We claim:

1. A process for cleaning an interior surface of an apparatus comprising:

generating a shock wave in the apparatus in a chamber that is separate from the surface to be cleaned;

directing the shock wave past the surface to be cleaned, wherein said shock wave is supersonic at the point of initial contact with the surface, to dislodge particles from the surface;

removing the particles with a gaseous stream.

2. The process of claim 1 wherein the gaseous stream flows continuously through the apparatus while the apparatus is being cleaned.

3. The process of claim 1 further comprising continuously generating the shock wave.

4. The process of claim 3 wherein the gaseous stream flows continuously through the apparatus while the apparatus is being cleaned.

5. The process of claim 5 wherein the apparatus is a heat exchanger.

6. The process of claim 2 wherein the gaseous stream is a process stream of a process being performed by the apparatus concurrently with the apparatus being cleaned.

7. The process of claim 3 wherein the gaseous stream is a process stream of a process being performed by the apparatus concurrently with the apparatus being cleaned.

* * * * *

UNITED STATES PATENT AND TRADEMARK OFFICE

CERTIFICATE OF CORRECTION

PATENT NO. : 5,082,502

DATED : January 21, 1992

INVENTOR(S) : Kam B. Lee, et al

It is certified that error appears in the above-identified patent and that said Letters Patent is hereby corrected as shown below:

Column 6:

Claim 5, Line 1, "The process of Claim 5" should read -- The process of Claim 4.

Signed and Sealed this

Twenty-ninth Day of June, 1993

Attest:

Michael K. Kirk

MICHAEL K. KIRK

Attesting Officer

Acting Commissioner of Patents and Trademarks